US007688274B2

(12) United States Patent
Gorrell et al.

(10) Patent No.: US 7,688,274 B2
(45) **Date of Patent: *Mar. 30, 2010**

(54) INTEGRATED FILTER IN ANTENNA-BASED DETECTOR

(75) Inventors: Jonathan Gorrell, Gainesville, FL (US); Mark Davidson, Florahome, FL (US); Michael E. Maines, Gainesville, FL (US)

(73) Assignee: Virgin Islands Microsystems, Inc., St. Thomas, VI (US)

( * ) Notice: Subject to any disclaimer, the term of this patent is extended or adjusted under 35 U.S.C. 154(b) by 212 days.

This patent is subject to a terminal disclaimer.

(21) Appl. No.: 11/711,000

(22) Filed: Feb. 27, 2007

(65) Prior Publication Data

US 2007/0200770 A1 Aug. 30, 2007

Related U.S. Application Data

(63) Continuation of application No. 11/417,129, filed on May 4, 2006, now Pat. No. 7,443,358.

(60) Provisional application No. 60/777,120, filed on Feb. 28, 2006.

(51) Int. Cl.
*H01Q 1/52* (2006.01)

(52) U.S. Cl. ..... 343/841; 333/202; 343/783

(58) Field of Classification Search ..... 343/700 MS, 343/841, 783; 333/202
See application file for complete search history.

(56) References Cited

U.S. PATENT DOCUMENTS

| | | | |
|---|---|---|---|
| 1,948,384 | A | 2/1934 | Lawrence |
| 2,307,086 | A | 1/1943 | Varian et al. |
| 2,431,396 | A | 11/1947 | Hansell |
| 2,473,477 | A | 6/1949 | Smith |
| 2,634,372 | A | 4/1953 | Salisbury |
| 2,932,798 | A | 4/1960 | Kerst et al. |
| 2,944,183 | A | 7/1960 | Drexler |
| 2,966,611 | A | 12/1960 | Sandstrom |
| 3,231,779 | A | 1/1966 | White |
| 3,297,905 | A | 1/1967 | Rockwell et al. |
| 3,315,117 | A | 4/1967 | Udelson |
| 3,387,169 | A | 6/1968 | Farney |

(Continued)

FOREIGN PATENT DOCUMENTS

EP 0237559 B1 12/1991

(Continued)

OTHER PUBLICATIONS

"Array of Nanoklystrons for Frequency Agility or Redundancy," NASA's Jet Propulsion Laboratory, NASA Tech Briefs, NPO-21033. 2001.

(Continued)

*Primary Examiner*—Tan Ho
(74) *Attorney, Agent, or Firm*—Davidson Berquist Jackson & Gowdey LLP

(57) ABSTRACT

An antenna system includes a dielectric structure formed on a substrate; an antenna, partially within the dielectric structure, and supported by the dielectric structure; a reflective surface formed on the substrate. A shield blocks radiation from a portion of the antenna and from at least some of the dielectric structure. The shield is supported by the dielectric structure.

12 Claims, 6 Drawing Sheets

U.S. PATENT DOCUMENTS

| | | | | |
|---|---|---|---|---|
| 3,543,147 | A | | 11/1970 | Kovarik |
| 3,546,524 | A | | 12/1970 | Stark |
| 3,560,694 | A | | 2/1971 | White |
| 3,571,642 | A | | 3/1971 | Westcott |
| 3,586,899 | A | | 6/1971 | Fleisher |
| 3,761,828 | A | | 9/1973 | Pollard et al. |
| 3,886,399 | A | | 5/1975 | Symons |
| 3,923,568 | A | | 12/1975 | Bersin |
| 3,989,347 | A | | 11/1976 | Eschler |
| 4,053,845 | A | | 10/1977 | Gould |
| 4,282,436 | A | | 8/1981 | Kapetanakos |
| 4,450,554 | A | | 5/1984 | Steensma et al. |
| 4,453,108 | A | | 6/1984 | Freeman, Jr. |
| 4,482,779 | A | | 11/1984 | Anderson |
| 4,528,659 | A | | 7/1985 | Jones, Jr. |
| 4,589,107 | A | | 5/1986 | Middleton et al. |
| 4,598,397 | A | | 7/1986 | Nelson et al. |
| 4,630,262 | A | | 12/1986 | Callens et al. |
| 4,652,703 | A | | 3/1987 | Lu et al. |
| 4,661,783 | A | | 4/1987 | Gover et al. |
| 4,704,583 | A | | 11/1987 | Gould |
| 4,712,042 | A | | 12/1987 | Hamm |
| 4,713,581 | A | | 12/1987 | Haimson |
| 4,727,550 | A | | 2/1988 | Chang et al. |
| 4,740,963 | A | | 4/1988 | Eckley |
| 4,740,973 | A | | 4/1988 | Madey |
| 4,746,201 | A | | 5/1988 | Gould |
| 4,761,059 | A | | 8/1988 | Yeh et al. |
| 4,782,485 | A | | 11/1988 | Gollub |
| 4,789,945 | A | | 12/1988 | Niijima |
| 4,806,859 | A | | 2/1989 | Hetrick |
| 4,809,271 | A | | 2/1989 | Kondo et al. |
| 4,813,040 | A | | 3/1989 | Futato |
| 4,819,228 | A | | 4/1989 | Baran et al. |
| 4,829,527 | A | | 5/1989 | Wortman et al. |
| 4,838,021 | A | | 6/1989 | Beattie |
| 4,841,538 | A | | 6/1989 | Yanabu et al. |
| 4,864,131 | A | | 9/1989 | Rich et al. |
| 4,866,704 | A | | 9/1989 | Bergman |
| 4,866,732 | A | | 9/1989 | Carey et al. |
| 4,873,715 | A | | 10/1989 | Shibata |
| 4,887,265 | A | | 12/1989 | Felix |
| 4,890,282 | A | | 12/1989 | Lambert et al. |
| 4,898,022 | A | | 2/1990 | Yumoto et al. |
| 4,912,705 | A | | 3/1990 | Paneth et al. |
| 4,932,022 | A | | 6/1990 | Keeney et al. |
| 4,981,371 | A | | 1/1991 | Gurak et al. |
| 5,023,563 | A | | 6/1991 | Harvey et al. |
| 5,036,513 | A | | 7/1991 | Greenblatt |
| 5,065,425 | A | | 11/1991 | Lecomte et al. |
| 5,113,141 | A | | 5/1992 | Swenson |
| 5,121,385 | A | | 6/1992 | Tominaga et al. |
| 5,127,001 | A | | 6/1992 | Steagall et al. |
| 5,128,729 | A | | 7/1992 | Alonas et al. |
| 5,130,985 | A | | 7/1992 | Kondo et al. |
| 5,150,410 | A | | 9/1992 | Bertrand |
| 5,155,726 | A | | 10/1992 | Spinney et al. |
| 5,157,000 | A | | 10/1992 | Elkind et al. |
| 5,163,118 | A | | 11/1992 | Lorenzo et al. |
| 5,185,073 | A | | 2/1993 | Bindra |
| 5,187,591 | A | | 2/1993 | Guy et al. |
| 5,199,918 | A | | 4/1993 | Kumar |
| 5,214,650 | A | | 5/1993 | Renner et al. |
| 5,233,623 | A | | 8/1993 | Chang |
| 5,235,248 | A | | 8/1993 | Clark et al. |
| 5,262,656 | A | | 11/1993 | Blondeau et al. |
| 5,263,043 | A | | 11/1993 | Walsh |
| 5,268,693 | A | | 12/1993 | Walsh |
| 5,268,788 | A | | 12/1993 | Fox et al. |
| 5,282,197 | A | | 1/1994 | Kreitzer |
| 5,283,819 | A | | 2/1994 | Glick et al. |
| 5,293,175 | A | * | 3/1994 | Hemmie et al. ..... 343/795 |
| 5,302,240 | A | | 4/1994 | Hori et al. |
| 5,305,312 | A | | 4/1994 | Fornek et al. |
| 5,341,374 | A | | 8/1994 | Lewen et al. |
| 5,354,709 | A | | 10/1994 | Lorenzo et al. |
| 5,446,814 | A | | 8/1995 | Kuo et al. |
| 5,504,341 | A | | 4/1996 | Glavish |
| 5,578,909 | A | | 11/1996 | Billen |
| 5,604,352 | A | | 2/1997 | Schuetz |
| 5,608,263 | A | | 3/1997 | Drayton et al. |
| 5,663,971 | A | | 9/1997 | Carlsten |
| 5,666,020 | A | | 9/1997 | Takemura |
| 5,668,368 | A | | 9/1997 | Sakai et al. |
| 5,705,443 | A | | 1/1998 | Stauf et al. |
| 5,737,458 | A | | 4/1998 | Wojnarowski et al. |
| 5,744,919 | A | | 4/1998 | Mishin et al. |
| 5,757,009 | A | | 5/1998 | Walstrom |
| 5,767,013 | A | | 6/1998 | Park |
| 5,780,970 | A | | 7/1998 | Singh et al. |
| 5,790,585 | A | | 8/1998 | Walsh |
| 5,811,943 | A | | 9/1998 | Mishin et al. |
| 5,821,836 | A | | 10/1998 | Katehi et al. |
| 5,821,902 | A | * | 10/1998 | Keen ..... 343/700 MS |
| 5,825,140 | A | | 10/1998 | Fujisawa |
| 5,831,270 | A | | 11/1998 | Nakasuji |
| 5,847,745 | A | | 12/1998 | Shimizu et al. |
| 5,889,449 | A | | 3/1999 | Fiedziuszko |
| 5,889,797 | A | | 3/1999 | Nguyen |
| 5,902,489 | A | | 5/1999 | Yasuda et al. |
| 5,963,857 | A | | 10/1999 | Greywall |
| 5,972,193 | A | | 10/1999 | Chou et al. |
| 6,005,347 | A | | 12/1999 | Lee |
| 6,008,496 | A | | 12/1999 | Winefordner et al. |
| 6,040,625 | A | | 3/2000 | Ip |
| 6,060,833 | A | | 5/2000 | Velazco |
| 6,080,529 | A | | 6/2000 | Ye et al. |
| 6,117,784 | A | | 9/2000 | Uzoh |
| 6,139,760 | A | | 10/2000 | Shim et al. |
| 6,180,415 | B1 | | 1/2001 | Schultz et al. |
| 6,195,199 | B1 | | 2/2001 | Yamada |
| 6,222,866 | B1 | | 4/2001 | Seko |
| 6,278,239 | B1 | | 8/2001 | Caporaso et al. |
| 6,281,769 | B1 | | 8/2001 | Fiedziuszko |
| 6,297,511 | B1 | | 10/2001 | Syllaios et al. |
| 6,301,041 | B1 | | 10/2001 | Yamada |
| 6,309,528 | B1 | | 10/2001 | Taylor et al. |
| 6,316,876 | B1 | | 11/2001 | Tanabe |
| 6,338,968 | B1 | | 1/2002 | Hefti |
| 6,370,306 | B1 | | 4/2002 | Sato et al. |
| 6,373,194 | B1 | | 4/2002 | Small |
| 6,376,258 | B2 | | 4/2002 | Hefti |
| 6,407,516 | B1 | | 6/2002 | Victor |
| 6,441,298 | B1 | | 8/2002 | Thio |
| 6,448,850 | B1 | | 9/2002 | Yamada |
| 6,453,087 | B2 | | 9/2002 | Frish et al. |
| 6,470,198 | B1 | | 10/2002 | Kintaka et al. |
| 6,504,303 | B2 | | 1/2003 | Small |
| 6,525,477 | B2 | | 2/2003 | Small |
| 6,534,766 | B2 | | 3/2003 | Abe et al. |
| 6,545,425 | B2 | | 4/2003 | Victor |
| 6,552,320 | B1 | | 4/2003 | Pan |
| 6,577,040 | B2 | | 6/2003 | Nguyen |
| 6,580,075 | B2 | | 6/2003 | Kametani et al. |
| 6,603,781 | B1 | | 8/2003 | Stinson et al. |
| 6,603,915 | B2 | | 8/2003 | Glebov et al. |
| 6,624,916 | B1 | | 9/2003 | Green et al. |
| 6,636,185 | B1 | | 10/2003 | Spitzer et al. |
| 6,636,534 | B2 | | 10/2003 | Madey et al. |
| 6,636,653 | B2 | | 10/2003 | Miracky et al. |
| 6,640,023 | B2 | | 10/2003 | Miller et al. |
| 6,642,907 | B2 | * | 11/2003 | Hamada et al. ..... 343/873 |
| 6,687,034 | B2 | | 2/2004 | Wine et al. |
| 6,700,748 | B1 | | 3/2004 | Cowles et al. |

6,724,486 B1 4/2004 Shull et al.
6,738,176 B2 5/2004 Rabinowitz et al.
6,741,781 B2 5/2004 Furuyama
6,777,244 B2 8/2004 Pepper et al.
6,782,205 B2 8/2004 Trisnadi et al.
6,791,438 B2 9/2004 Takahashi et al.
6,800,877 B2 10/2004 Victor et al.
6,801,002 B2 10/2004 Victor et al.
6,819,432 B2 11/2004 Pepper et al.
6,829,286 B1 12/2004 Guilfoyle et al.
6,834,152 B2 12/2004 Gunn et al.
6,870,438 B1 3/2005 Shino et al.
6,871,025 B2 3/2005 Maleki et al.
6,885,262 B2 4/2005 Nishimura et al.
6,900,447 B2 5/2005 Gerlach et al.
6,909,092 B2 6/2005 Nagahama
6,909,104 B1 6/2005 Koops
6,924,920 B2 8/2005 Zhilkov
6,936,981 B2 8/2005 Gesley
6,943,650 B2 9/2005 Ramprasad et al.
6,944,369 B2 9/2005 Deliwala
6,952,492 B2 10/2005 Tanaka et al.
6,953,291 B2 10/2005 Liu
6,954,515 B2 10/2005 Bjorkholm et al.
6,965,284 B2 11/2005 Maekawa et al.
6,965,625 B2 11/2005 Mross et al.
6,972,439 B1 12/2005 Kim et al.
6,995,406 B2 2/2006 Tojo et al.
7,010,183 B2 3/2006 Estes et al.
7,064,500 B2 6/2006 Victor et al.
7,068,948 B2 6/2006 Wei et al.
7,092,588 B2 8/2006 Kondo
7,092,603 B2 8/2006 Glebov et al.
7,122,978 B2 10/2006 Nakanishi et al.
7,130,102 B2 10/2006 Rabinowitz
7,177,515 B2 2/2007 Estes et al.
7,194,798 B2 3/2007 Bonhote et al.
7,230,201 B1 6/2007 Miley et al.
7,253,426 B2 8/2007 Gorrell et al.
7,267,459 B2 9/2007 Matheson
7,267,461 B2 9/2007 Kan et al.
7,309,953 B2 12/2007 Tiberi et al.
7,342,441 B2 3/2008 Gorrell et al.
7,362,972 B2 4/2008 Yavor et al.
7,375,631 B2 5/2008 Moskowitz et al.
7,436,177 B2 10/2008 Gorrell et al.
7,442,940 B2 10/2008 Gorrell et al.
7,443,358 B2 * 10/2008 Gorrell et al. ..... 343/841
7,470,920 B2 12/2008 Gorrell et al.
7,473,917 B2 1/2009 Singh
7,586,097 B2 9/2009 Gorrell et al.
7,586,167 B2 9/2009 Gorrell et al.
2001/0002315 A1 5/2001 Schultz et al.
2001/0025925 A1 10/2001 Abe et al.
2002/0009723 A1 1/2002 Hefti
2002/0027481 A1 3/2002 Fiedziuszko
2002/0036121 A1 3/2002 Ball et al.
2002/0036264 A1 3/2002 Nakasuji et al.
2002/0053638 A1 5/2002 Winkler et al.
2002/0068018 A1 6/2002 Pepper et al.
2002/0070671 A1 6/2002 Small
2002/0071457 A1 6/2002 Hogan
2002/0122531 A1 9/2002 Whitham
2002/0135665 A1 9/2002 Gardner
2002/0139961 A1 10/2002 Kinoshita et al.
2002/0158295 A1 10/2002 Armgarth et al.
2002/0191650 A1 12/2002 Madey et al.
2003/0010979 A1 1/2003 Pardo et al.
2003/0012925 A1 1/2003 Gorrell
2003/0016421 A1 1/2003 Small
2003/0034535 A1 2/2003 Barenburu et al.
2003/0103150 A1 6/2003 Catrysse et al.
2003/0106998 A1 6/2003 Colbert et al.
2003/0155521 A1 8/2003 Feuerbaum
2003/0158474 A1 8/2003 Scherer et al.
2003/0164947 A1 9/2003 Vaupel
2003/0179974 A1 9/2003 Estes et al.
2003/0206708 A1 11/2003 Estes et al.
2003/0214695 A1 11/2003 Abramson et al.
2004/0061053 A1 4/2004 Taniguchi et al.
2004/0080285 A1 4/2004 Victor et al.
2004/0085159 A1 5/2004 Kubena et al.
2004/0092104 A1 5/2004 Gunn, III et al.
2004/0108471 A1 6/2004 Luo et al.
2004/0108473 A1 6/2004 Melnychuk et al.
2004/0108823 A1 6/2004 Amaldi et al.
2004/0136715 A1 7/2004 Kondo
2004/0150991 A1 8/2004 Ouderkirk et al.
2004/0171272 A1 9/2004 Jin et al.
2004/0180244 A1 9/2004 Tour et al.
2004/0184270 A1 9/2004 Halter
2004/0213375 A1 10/2004 Bjorkholm et al.
2004/0217297 A1 11/2004 Moses et al.
2004/0218651 A1 11/2004 Iwasaki et al.
2004/0231996 A1 11/2004 Webb
2004/0240035 A1 12/2004 Zhilkov
2004/0264867 A1 12/2004 Kondo
2005/0023145 A1 2/2005 Cohen et al.
2005/0045821 A1 3/2005 Noji et al.
2005/0045832 A1 3/2005 Kelly et al.
2005/0054151 A1 3/2005 Lowther et al.
2005/0067286 A1 3/2005 Ahn et al.
2005/0082469 A1 4/2005 Carlo
2005/0092929 A1 5/2005 Schneiker
2005/0104684 A1 5/2005 Wojcik
2005/0105690 A1 5/2005 Pau et al.
2005/0145882 A1 7/2005 Taylor et al.
2005/0152635 A1 7/2005 Paddon et al.
2005/0162104 A1 7/2005 Victor et al.
2005/0190637 A1 9/2005 Ichimura et al.
2005/0194258 A1 9/2005 Cohen et al.
2005/0201707 A1 9/2005 Glebov et al.
2005/0201717 A1 9/2005 Matsumura et al.
2005/0212503 A1 9/2005 Deibele
2005/0231138 A1 10/2005 Nakanishi et al.
2005/0249451 A1 11/2005 Baehr-Jones et al.
2005/0285541 A1 12/2005 LeChevalier
2006/0007730 A1 1/2006 Nakamura et al.
2006/0018619 A1 * 1/2006 Helffrich et al. ..... 385/134
2006/0035173 A1 2/2006 Davidson et al.
2006/0045418 A1 3/2006 Cho et al.
2006/0050269 A1 3/2006 Brownell
2006/0060782 A1 3/2006 Khursheed
2006/0062258 A1 3/2006 Brau et al.
2006/0131176 A1 6/2006 Hsu
2006/0131695 A1 6/2006 Kuekes et al.
2006/0159131 A1 7/2006 Liu et al.
2006/0164496 A1 7/2006 Tokutake et al.
2006/0187794 A1 8/2006 Harvey et al.
2006/0208667 A1 9/2006 Lys et al.
2006/0216940 A1 9/2006 Gorrell et al.
2006/0243925 A1 11/2006 Barker et al.
2006/0274922 A1 12/2006 Ragsdale
2007/0003781 A1 1/2007 de Rochemont
2007/0013765 A1 1/2007 Hudson et al.
2007/0075263 A1 4/2007 Gorrell et al.
2007/0075264 A1 4/2007 Gorrell et al.
2007/0085039 A1 4/2007 Gorrell et al.
2007/0086915 A1 4/2007 LeBoeuf et al.
2007/0116420 A1 5/2007 Estes et al.
2007/0146704 A1 6/2007 Schmidt et al.
2007/0152176 A1 7/2007 Gorrell et al.
2007/0154846 A1 7/2007 Gorrell et al.
2007/0194357 A1 8/2007 Oohashi et al.
2007/0200940 A1 8/2007 Gruhlke et al.
2007/0238037 A1 10/2007 Wuister et al.

| | | | |
|---|---|---|---|
| 2007/0252983 | A1 | 11/2007 | Tong et al. |
| 2007/0258492 | A1 | 11/2007 | Gorrell |
| 2007/0258689 | A1 | 11/2007 | Gorrell et al. |
| 2007/0258690 | A1 | 11/2007 | Gorrell et al. |
| 2007/0259641 | A1 | 11/2007 | Gorrell |
| 2007/0264023 | A1 | 11/2007 | Gorrell et al. |
| 2007/0264030 | A1 | 11/2007 | Gorrell et al. |
| 2007/0282030 | A1 | 12/2007 | Anderson et al. |
| 2007/0284527 | A1 | 12/2007 | Zani et al. |
| 2008/0069509 | A1 | 3/2008 | Gorrell et al. |
| 2008/0302963 | A1 | 12/2008 | Nakasuji et al. |

FOREIGN PATENT DOCUMENTS

| | | | |
|---|---|---|---|
| JP | 2004-32323 | A | 1/2004 |
| WO | WO 87/01873 | | 3/1987 |
| WO | WO 93/21663 | A1 | 10/1993 |
| WO | WO 00/72413 | | 11/2000 |
| WO | WO 02/25785 | | 3/2002 |
| WO | WO 02/077607 | | 10/2002 |
| WO | WO 2004/086560 | | 10/2004 |
| WO | WO 2005/015143 | A2 | 2/2005 |
| WO | WO 2005/098966 | | 10/2005 |
| WO | WO 2006/042239 | A2 | 4/2006 |
| WO | WO 2007/081389 | | 7/2007 |
| WO | WO 2007/081390 | | 7/2007 |
| WO | WO 2007/081391 | | 7/2007 |

OTHER PUBLICATIONS

"Hardware Development Programs," Calabazas Creek Research, Inc. found at http://calcreek.com/hardware.html.

"Antenna Arrays." May 18, 2002. www.tpub.com/content/neets/14183/css/14183_159.htm.

"Diffraction Grating," hyperphysics.phy-astr.gsu.edu/hbase/phyopt/grating.html.

Alford, T.L. et al., "Advanced silver-based metallization patterning for ULSI applications," Microelectronic Engineering 55, 2001, pp. 383-388, Elsevier Science B.V.

Amato, Ivan, "An Everyman's Free-Electron Laser?" Science, New Series, Oct. 16, 1992, p. 401, vol. 258 No. 5081, American Association for the Advancement of Science.

Andrews, H.L. et al., "Dispersion and Attenuation in a Smith-Purcell Free Electron Laser," The American Physical Society, Physical Review Special Topics—Accelerators and Beams 8 (2005), pp. 050703-1-050703-9.

Backe, H. et al. "Investigation of Far-Infrared Smith-Purcell Radiation at the 3.41 MeV Electron Injector Linac of the Mainz Microtron MAMI," Institut fur Kernphysik, Universitat Mainz, D-55099, Mainz Germany.

Bakhtyari, A. et al., "Horn Resonator Boosts Miniature Free-Electron Laser Power," Applied Physics Letters, May 12, 2003, pp. 3150-3152, vol. 82, No. 19, American Institute of Physics.

Bakhtyari, Dr. Arash, "Gain Mechanism in a Smith-Purcell MicroFEL," Abstract, Department of Physics and Astronomy, Dartmouth College.

Bhattacharjee, Sudeep et al., "Folded Waveguide Traveling-Wave Tube Sources for Terahertz Radiation." IEEE Transactions on Plasma Science, vol. 32. No. 3, Jun. 2004, pp. 1002-1014.

Booske, J.H. et al., "Microfabricated TWTs as High Power, Wideband Sources of THz Radiation".

Brau, C.A. et al., "Gain and Coherent Radiation from a Smith-Purcell Free Electron Laser," Proceedings of the 2004 FEL Conference, pp. 278-281.

Brownell, J.H. et al., "Improved μFEL Performance with Novel Resonator," Jan. 7, 2005, from website: www.frascati.enea.it/thz-bridge/workshop/presentations/Wednesday/We-07-Brownell.ppt.

Brownell, J.H. et al., "The Angular Distribution of the Power Produced by Smith-Purcell Radiation," J. Phys. D: Appl. Phys. 1997, pp. 2478-2481, vol. 30, IOP Publishing Ltd., United Kingdom.

Chuang, S.L. et al., "Enhancement of Smith-Purcell Radiation from a Grating with Surface-Plasmon Excitation," Journal of the Optical Society of America, Jun. 1984, pp. 672-676, vol. 1 No. 6, Optical Society of America.

Chuang, S.L. et al., "Smith-Purcell Radiation from a Charge Moving Above a Penetrable Grating," IEEE MTT-S Digest, 1983, pp. 405-406, IEEE.

Far-IR, Sub-MM & MM Detector Technology Workshop list of manuscripts, session 6 2002.

Feltz, W.F. et al., "Near-Continuous Profiling of Temperature, Moisture, and Atmospheric Stability Using the Atmospheric Emitted Radiance Interferometer (AERI)," Journal of Applied Meteorology, May 2003, vol. 42 No. 5, H.W. Wilson Company, pp. 584-597.

Freund, H.P. et al., "Linearized Field Theory of a Smith-Purcell Traveling Wave Tube," IEEE Transactions on Plasma Science, Jun. 2004, pp. 1015-1027, vol. 32 No. 3, IEEE.

Gallerano, G.P. et al., "Overview of Terahertz Radiation Sources," Proceedings of the 2004 FEL Conference, pp. 216-221.

Goldstein, M. et al., "Demonstration of a Micro Far-Infrared Smith-Purcell Emitter," Applied Physics Letters, Jul. 28, 1997, pp. 452-454, vol. 71 No. 4, American Institute of Physics.

Gover, A. et al., "Angular Radiation Pattern of Smith-Purcell Radiation," Journal of the Optical Society of America, Oct. 1984, pp. 723-728, vol. 1 No. 5, Optical Society of America.

Grishin, Yu. A. et al., "Pulsed Orotron—A New Microwave Source for Submillimeter Pulse High -Field Electron Paramagnetic Resonance Spectroscopy," Review of Scientific Instruments, Sep. 2004, pp. 2926-2936, vol. 75 No. 9, American Institute of Physics.

Ishizuka, H. et al., "Smith-Purcell Experiment Utilizing a Field-Emitter Array Cathode: Measurements of Radiation," Nuclear Instruments and Methods in Physics Research, 2001, pp. 593-598, A 475, Elsevier Science B.V.

Ishizuka, H. et al., "Smith-Purcell Radiation Experiment Using a Field-Emission Array Cathode," Nuclear Instruments and Methods in Physics Research, 2000, pp. 276-280, A 445, Elsevier Science B.V.

Ives, Lawrence et al., "Development of Backward Wave Oscillators for Terahertz Applications," Terahertz for Military and Security Applications, Proceedings of SPIE vol. 5070 (2003), pp. 71-82.

Ives, R. Lawrence, "IVEC Summary, Session 2, Sources I" 2002.

Jonietz, Erika, "Nano Antenna Gold nanospheres show path to all-optical computing," Technology Review, Dec. 2005/Jan. 2006, p. 32.

Joo, Youngcheol et al., "Air Cooling of IC Chip with Novel Microchannels Monolithically Formed on Chip Front Surface," Cooling and Thermal Design of Electronic Systems (HTD-vol. 319 & EEP-vol. 15), International Mechanical Engineering Congress and Exposition, San Francisco, CA Nov. 1995 pp. 117-121.

Joo, Youngcheol et al., "Fabrication of Monolithic Microchannels for IC Chip Cooling," 1995, Mechanical, Aerospace and Nuclear Engineering Department, University of California at Los Angeles.

Jung, K.B. et al., "Patterning of Cu, Co, Fe, and Ag for magnetic nanostructures," J. Vac. Sci. Technol. A 15(3), May/Jun. 1997, pp. 1780-1784.

Kapp, Oscar H. et al., "Modification of a Scanning Electron Microscope to Produce Smith-Purcell Radiation," Review of Scientific Instruments, Nov. 2004, pp. 4732-4741, vol. 75 No. 11, American Institute of Physics.

Kiener, C. et al., "Investigation of the Mean Free Path of Hot Electrons in GaAs/AlGaAs Heterostructures," Semicond. Sci. Technol., 1994, pp. 193-197, vol. 9, IOP Publishing Ltd., United Kingdom.

Kim, Shang Hoon, "Quantum Mechanical Theory of Free-Electron Two-Quantum Stark Emission Driven by Transverse Motion," Journal of the Physical Society of Japan, Aug. 1993, vol. 62 No. 8, pp. 2528-2532.

Korbly, S.E. et al., "Progress on a Smith-Purcell Radiation Bunch Length Diagnostic," Plasma Science and Fusion Center, MIT, Cambridge, MA.

Kormann, T. et al., "A Photoelectron Source for the Study of Smith-Purcell Radiation".

Kube, G. et al., "Observation of Optical Smith-Purcell Radiation at an Electron Beam Energy of 855 MeV," Physical Review E, May 8, 2002, vol. 65, The American Physical Society, pp. 056501-1-056501-15.

Lee Kwang-Cheol et al., "Deep X-Ray Mask with Integrated Actuator for 3D Microfabrication", Conference: Pacific Rim Workshop on Transducers and Micro/Nano Technologies, (Xiamen CHN), Jul. 22, 2002.

Liu, Chuan Sheng, et al., "Stimulated Coherent Smith-Purcell Radiation from a Metallic Grating," IEEE Journal of Quantum Electronics, Oct. 1999, pp. 1386-1389, vol. 35, No. 10, IEEE.
Manohara, Harish et al., "Field Emission Testing of Carbon Nanotubes for THz Frequency Vacuum Microtube Sources." Abstract. Dec. 2003. from SPIEWeb.
Manohara, Harish M. et al, "Design and Fabrication of a THz Nanoklystron".
Manohara, Harish M. et al., "Design and Fabrication of a THz Nanoklystron" (www.sofia.usra.edu/det_workshop/ posters/session 3/3-43manohara_poster.pdf), PowerPoint Presentation.
Markoff, John, "A Chip That Can Transfer Data Using Laser Light," The New York Times, Sep. 18, 2006.
McDaniel, James C. et al., "Smith-Purcell Radiation in the High Conductivity and Plasma Frequency Limits," Applied Optics, Nov. 15, 1989, pp. 4924-4929, vol. 28 No. 22, Optical Society of America.
Meyer, Stephan, "Far IR, Sub-MM & MM Detector Technology Workshop Summary," Oct. 2002. (may date the Manohara documents).
Mokhoff, Nicolas, "Optical-speed light detector promises fast space talk," EETimes Online, Mar. 20, 2006, from website: www.eetimes.com/showArticle.jhtml?articleID=183701047.
Nguyen, Phucanh et al., "Novel technique to pattern silver using CF4 and CF4/O2 glow discharges," J.Vac. Sci. Technol. B 19(1), Jan./Feb. 2001, American Vacuum Society, pp. 158-165.
Nguyen, Phucanh et al., "Reactive ion etch of patterned and blanket silver thin films in CI2/O2 and O2 glow discharges," J. Vac. Sci, Technol. B. 17 (5), Sep./Oct. 1999, American Vacuum Society, pp. 2204-2209.
Ohtaka, Kazuo, "Smith-Purcell Radiation from Metallic and Dielectric Photonic Crystals," Center for Frontier Science, pp. 272-273, Chiba University, 1-33 Yayoi, Inage-ku, Chiba-shi, Japan.
Phototonics Research, "Surface-Plasmon-Enhanced Random Laser Demonstrated," Phototonics Spectra, Feb. 2005, pp. 112-113.
Platt, C.L. et al., "A New Resonator Design for Smith-Purcell Free Electron Lasers," 6Q19, p. 296.
Potylitsin, A.P., "Resonant Diffraction Radiation and Smith-Purcell Effect," (Abstract), arXiv: physics/9803043 v2 Apr. 13, 1998.
Potylitsyn, A.P., "Resonant Diffraction Radiation and Smith-Purcell Effect," Physics Letters A, Feb. 2, 1998, pp. 112-116, A 238, Elsevier Science B.V.
S. Hoogland et al., "A solution-processed 1.53 μm quantum dot laser with temperature-invariant emission wavelength," Optics Express, vol. 14, No. 8, Apr. 17, 2006, pp. 3273-3281.
S.M. Sze, "Semiconductor Devices Physics and Technology", 2nd Edition, Chapters 9 and 12, Copyright 1985, 2002.
Savilov, Andrey V., "Stimulated Wave Scattering in the Smith-Purcell FEL," IEEE Transactions on Plasma Science, Oct. 2001, pp. 820-823, vol. 29 No. 5, IEEE.
Schachter, Levi et al., "Smith-Purcell Oscillator in an Exponential Gain Regime," Journal of Applied Physics, Apr. 15, 1989, pp. 3267-3269, vol. 65 No. 8, American Institute of Physics.
Schachter, Levi, "Influence of the Guiding Magnetic Field on the Performance of a Smith-Purcell Amplifier Operating in the Weak Compton Regime," Journal of the Optical Society of America, May 1990, pp. 873-876, vol. 7 No. 5, Optical Society of America.
Schachter, Levi, "The Influence of the Guided Magnetic Field on the Performance of a Smith-Purcell Amplifier Operating in the Strong Compton Regime," Journal of Applied Physics, Apr. 15, 1990, pp. 3582-3592, vol. 67 No. 8, American Institute of Physics.
Search Report and Written Opinion mailed Feb. 12, 2007 in PCT Appln. No. PCT/US2006/022682.
Search Report and Written Opinion mailed Feb. 20, 2007 in PCT Appln. No. PCT/US2006/022676.
Search Report and Written Opinion mailed Feb. 20, 2007 in PCT Appln. No. PCT/US2006/022772.
Search Report and Written Opinion mailed Feb. 20, 2007 in PCT Appln. No. PCT/US2006/022780.
Search Report and Written Opinion mailed Feb. 21, 2007 in PCT Appln. No. PCT/US2006/022684.
Search Report and Written Opinion mailed Jan. 17, 2007 in PCT Appln. No. PCT/US2006/022777.
Search Report and Written Opinion mailed Jan. 23, 2007 in PCT Appln. No. PCT/US2006/022781.
Search Report and Written Opinion mailed Mar. 7, 2007 in PCT Appln. No. PCT/US2006/022775.
Shih, I. et al., "Experimental Investigations of Smith-Purcell Radiation," Journal of the Optical Society of America, Mar. 1990, pp. 351-356, vol. 7, No. 3, Optical Society of America.
Shih, I. et al., "Measurements of Smith-Purcell Radiation," Journal of the Optical Society of America, Mar. 1990, pp. 345-350, vol. 7 No. 3, Optical Society of America.
Speller et al., "A Low-Noise MEMS Accelerometer for Unattended Ground Sensor Applications", Applied MEMS Inc., 12200 Parc Crest, Stafford, TX, USA 77477.
Swartz, J.C. et al., "THz-FIR Grating Coupled Radiation Source," Plasma Science, 1998. 1D02, p. 126.
Temkin, Richard, "Scanning with Ease Through the Far Infrared," Science, New Series, May 8, 1998, p. 854, vol. 280, No. 5365, American Association for the Advancement of Science.
Thurn-Albrecht et al., "Ultrahigh-Density Nanowire Arrays Grown in Self-Assembled Diblock Copolymer Templates", Science 290. 5499, Dec. 15, 2000, pp. 2126-2129.
Walsh, J.E., et al., 1999. From website: http://www.ieee.org/organizations/pubs/newsletters/leos/feb99/hot2.htm.
Wentworth, Stuart M. et al., "Far-Infrared Composite Microbolometers," IEEE MTT-S Digest, 1990, pp. 1309-1310.
Yamamoto, N. et al., "Photon Emission From Silver Particles Induced by a High-Energy Electron Beam," Physical Review B, Nov. 6, 2001, pp. 205419-1-205419-9, vol. 64, The American Physical Society.
Yokoo, K. et al., "Smith-Purcell Radiation at Optical Wavelength Using a Field-Emitter Array," Technical Digest of IVMC, 2003, pp. 77-78.
Zeng, Yuxiao et al., "Processing and encapsulation of silver patterns by using reactive ion etch and ammonia anneal," Materials Chemistry and Physics 66, 2000, pp. 77-82.
Search Report and Written Opinion mailed Aug. 24, 2007 in PCT Appln. No. PCT/US2006/022768.
Search Report and Written Opinion mailed Aug. 31, 2007 in PCT Appln. No. PCT/US2006/022680.
Search Report and Written Opinion mailed Jul. 16, 2007 in PCT Appln. No. PCT/US2006/022774.
Search Report and Written Opinion mailed Jul. 20, 2007 in PCT Appln. No. PCT/US2006/024216.
Search Report and Written Opinion mailed Jul. 26, 2007 in PCT Appln. No. PCT/US2006/022776.
Search Report and Written Opinion mailed Jun. 20, 2007 in PCT Appln. No. PCT/US2006/022779.
Search Report and Written Opinion mailed Sep. 12, 2007 in PCT Appln. No. PCT/US2006/022767.
Search Report and Written Opinion mailed Sep. 13, 2007 in PCT Appln. No. PCT/US2006/024217.
Search Report and Written Opinion mailed Sep. 17, 2007 in PCT Appln. No. PCT/US2006/022787.
Search Report and Written Opinion mailed Sep. 5, 2007 in PCT Appln. No. PCT/US2006/027428.
Search Report and Written Opinion mailed Sep. 17, 2007 in PCT Appln. No. PCT/US2006/022689.
International Search Report and Written Opinion mailed Nov. 23, 2007 in International Application No. PCT/US2006/022786.
Search Report and Written Opinion mailed Oct. 25, 2007 in PCT Appln. No. PCT/US2006/022687.
Search Report and Written Opinion mailed Oct. 26, 2007 in PCT Appln. No. PCT/US2006/022675.
Search Report and Written Opinion mailed Sep. 21, 2007 in PCT Appln. No. PCT/US2006/022688.
Search Report and Written Opinion mailed Sep. 25, 2007 in PCT appln. No. PCT/US2006/022681.
Search Report and Written Opinion mailed Sep. 26, 2007 in PCT Appln. No. PCT/US2006/024218.
U.S. Appl. No. 11/418,082 filed May 5, 2006, Gorrell et al.
"An Early History—Invention of the Klystron," http://varianinc.com/cgi-bin/advprint/print.cgi?cid=KLQNPPJJFJ, printed on Dec. 26, 2008.

"An Early History—The Founding of Varian Associates," http://varianinc.com/cgi-bin/advprint/print.cgi?cid=KLQNPPJJFJ, printed on Dec. 26, 2008.
"Chapter 3 E-Ray Tube," http://compepid.tuskegee.edu/syllabi/clinical/small/radiology/chapter..., printed from tuskegee.edu on Dec. 29, 2008.
"Diagnostic imaging modalities—Ionizing vs non-ionizing radiation," http://info.med.yale.edu/intmed/cardio/imaging/techniques/ionizing_v..., printed from Yale University School of Medicine on Dec. 29, 2008.
"Frequently Asked Questions," Luxtera Inc., found at http://www.luxtera.com/technology_faq.htm, printed on Dec. 2, 2005, 4 pages.
"Klystron Amplifier," http://www.radartutorial.eu/08.transmitters/tx12.en.html, printed on Dec. 26, 2008.
"Klystron is a Micowave Generator," http://www2.slac.stanford.edu/vvc/accelerators/klystron.html, printed on Dec. 26, 2008.
"Klystron," http:en.wikipedia.org/wiki/Klystron, printed on Dec. 26, 2008.
"Making E-rays," http://www.fnrfscience.cmu.ac.th/theory/radiation/xray-basics.html, printed on Dec. 29, 2008.
"Microwave Tubes," http://www.tpub.com/neets/book11/45b.htm, printed on Dec. 26, 2008.
"Notice of Allowability" mailed on Jan. 17, 2008 in U.S. Appl. No. 11/418,082, filed May 5, 2006.
"Technology Overview," Luxtera, Inc., found at http://www.luxtera.com/technology.htm, printed on Dec. 2, 2005, 1 page.
"The Reflex Klystron," http://www.fnrfscience.cmu.ac.th/theory/microwave/microwave%2, printed from Fast Netoron Research Facilty on Dec. 26, 2008.
"X-ray tube," http://www.answers.com/topic/x-ray-tube, printed on Dec. 29, 2008.
Corcoran, Elizabeth, "Ride the Light," Forbes Magazine, Apr. 11, 2005, pp. 68-70.
J. C. Palais, "Fiber optic communications," Prentice Hall, New Jersey, 1998, pp. 156-158.
Neo et al., "Smith-Purcell Radiation from Ultraviolet to Infrared Using a Si-field Emitter" Vacuum Electronics Conference, 2007, IVEC '07, IEEE International May 2007.
Ossia, Babak, "The X-Ray Production," Department of Biomedical Engineering—University of Rhode Island, 1 page.
Sadwick, Larry et al., "Microfabricated next-generation millimeter-wave power amplifiers," www.rfdesign.com.
Saraph, Girish P. et al., "Design of a Single-Stage Depressed Collector for High-Power, Pulsed Gyroklystrom Amplifiers," IEEE Transactions on Electron Devices, vol. 45, No. 4, Apr. 1998, pp. 986-990.
Sartori, Gabriele, "CMOS Photonics Platform," Luxtera, Inc., Nov. 2005, 19 pages.
Search Report and Writen Opinion mailed Jul. 14, 2008 in PCT Appln. No. PCT/US2006/022773.
Search Report and Written Opinion mailed Apr. 23, 2008 in PCT Appln. No. PCT/US2006/022678.
Search Report and Written Opinion mailed Apr. 3, 2008 in PCT Appln. No. PCT/US2006/027429.
Search Report and Written Opinion mailed Aug. 19, 2008 in PCT Appln. No. PCT/US2007/008363.
Search Report and Written Opinion mailed Dec. 20, 2007 in PCT Appln. No. PCT/US2006/022771.
Search Report and Written Opinion mailed Jan. 31, 2008 in PCT Appln. No. PCT/US2006/027427.
Search Report and Written Opinion mailed Jan. 8, 2008 in PCT Appln. No. PCT/US2006/028741.
Search Report and Written Opinion mailed Jul. 16, 2008 in PCT Appln. No. PCT/US2006/022766.
Search Report and Written Opinion mailed Jul. 28, 2008 in PCT Appln. No. PCT/US2006/022782.
Search Report and Written Opinion mailed Jul. 3, 2008 in PCT Appln. No. PCT/US2006/022690.
Search Report and Written Opinion mailed Jul. 3, 2008 in PCT Appln. No. PCT/US2006/022778.
Search Report and Written Opinion mailed Jul. 7, 2008 in PCT Appln. No. PCT/US2006/022686.
Search Report and Written Opinion mailed Jul. 7, 2008 in PCT Appln. No. PCT/US2006/022785.
Search Report and Written Opinion mailed Jun. 18, 2008 in PCT Appln. No. PCT/US2006/027430.
Search Report and Written Opinion mailed Jun. 3, 2008 in PCT Appln. No. PCT/US2006/022783.
Search Report and Written Opinion mailed Mar. 11, 2008 in PCT Appln. No. PCT/US2006/022679.
Search Report and Written Opinion mailed Mar. 24, 2008 in PCT Appln. No. PCT/US2006/022677.
Search Report and Written Opinion mailed Mar. 24, 2008 in PCT Appln. No. PCT/US2006/022784.
Search Report and Written Opinion mailed May 2, 2008 in PCT Appln. No. PCT/US2006/023280.
Search Report and Written Opinion mailed May 21, 2008 in PCT Appln. No. PCT/US2006/023279.
Search Report and Written Opinion mailed May 22, 2008 in PCT Appln. No. PCT/US2006/022685.
Search Report and Written Opinion mailed Sep. 2, 2008 in PCT Appln. No. PCT/US2006/022769.
Search Report and Written Opinion mailed Sep. 26, 2008 in PCT Appln. No. PCT/US2007/00053.
Search Report and Written Opinion mailed Sep. 3, 2008 in PCT Appln. No. PCT/US2006/022770.
Thumm, Manfred, "Historical German Contributions to Physics and Applications of Electromagnetic Oscillations and Waves."
Whiteside, Andy et al., "Dramatic Power Savings using Depressed Collector IOT Transmitters in Digital and Analog Service."
Mar. 24, 2006 PTO Office Action in U.S. Appl. No. 10/917,511.
Mar. 25, 2008 PTO Office Action in U.S. Appl. No. 11/411,131.
Apr. 8, 2008 PTO Office Action in U.S. Appl. No. 11/325,571.
Apr. 17, 2008 Response to PTO Office Action of Dec. 20, 2007 in U.S. Appl. No. 11/418,087.
Apr. 19, 2007 Response to PTO Office Action of Jan. 17, 2007 in U.S. Appl. No. 11/418,082.
May 10, 2005 PTO Office Action in U.S. Appl. No. 10/917,511.
May 21, 2007 PTO Office Action in U.S. Appl. No. 11/418,087.
May 26, 2006 Response to PTO Office Action of Mar. 24, 2006 in U.S. Appl. No. 10/917,511.
Jun. 16, 2008 Response to PTO Office Action of Dec. 14, 2007 in U.S. Appl. No. 11/418,264.
Jun. 20, 2008 Response to PTO Office Action of Mar. 25, 2008 in U.S. Appl. No. 11/411,131.
Aug. 14, 2006 PTO Office Action in U.S. Appl. No. 10/917,511.
Sep. 1, 2006 Response to PTO Office Action of Aug. 14, 2006 in U.S. Appl. No. 10/917,511.
Sep. 12, 2005 Response to PTO Office Action of May 10, 2005 in U.S. Appl. No. 10/917,511.
Sep. 14, 2007 PTO Office Action in U.S. Appl. No. 11/411,131.
Oct. 19, 2007 Response to PTO Office Action of May 21, 2007 in U.S. Appl. No. 11/418,087.
Dec. 4, 2006 PTO Office Action in U.S. Appl. No. 11/418,087.
Dec. 14, 2007 PTO Office Action in U.S. Appl. No. 11/418,264.
Dec. 14, 2007 Response to PTO Office Action of Sep. 14, 2007 in U.S. Appl. No. 11/411,131.
Dec. 20, 2007 PTO Office Action in U.S. Appl. No. 11/418,087.
European Search Report mailed Mar. 3, 2009 in European Application No. 06852028.7.
U.S. Appl. No. 11/203,407—Nov. 13, 2008 PTO Office Action.
U.S. Appl. No. 11/238,991—Dec. 6, 2006 PTO Office Action.
U.S. Appl. No. 11/238,991—Jun. 6, 2007 Response to PTO Office Action of Dec. 6, 2006.
U.S. Appl. No. 11/238,991—Sep. 10, 2007 PTO Office Action.
U.S. Appl. No. 11/238,991—Mar. 6, 2008 Response to PTO Office Action of Sep. 10, 2007.
U.S. Appl. No. 11/238,991—Jun. 27, 2008 PTO Office Action.
U.S. Appl. No. 11/238,991—Dec. 29, 2008 Response to PTO Office Action of Jun. 27, 2008.
U.S. Appl. No. 11/238,991—Mar. 24, 2009 PTO Office Action.
U.S. Appl. No. 11/243,477—Apr. 25, 2008 PTO Office Action.
U.S. Appl. No. 11/243,477—Oct. 24, 2008 Response to PTO Office Action of Apr. 25, 2008.
U.S. Appl. No. 11/243,477—Jan. 7, 2009 PTO Office Action.
U.S. Appl. No. 11/325,448—Jun. 16, 2008 PTO Office Action.

U.S. Appl. No. 11/325,448—Dec. 16, 2008 Response to PTO Office Action of Jun. 16, 2008.
U.S. Appl. No. 11/325,534—Jun. 11, 2008 PTO Office Action.
U.S. Appl. No. 11/325,534—Oct. 15, 2008 Response to PTO Office Action of Jun. 11, 2008.
U.S. Appl. No. 11/353,208—Jan. 15, 2008 PTO Office Action.
U.S. Appl. No. 11/353,208—Mar. 17, 2008 PTO Office Action.
U.S. Appl. No. 11/353,208—Sep. 15, 2008 Response to PTO Office Action of Mar. 17, 2008.
U.S. Appl. No. 11/353,208—Dec. 24, 2008 PTO Office Action.
U.S. Appl. No. 11/353,208—Dec. 30, 2008 Response to PTO Office Action of Dec. 24, 2008.
U.S. Appl. No. 11/400,280—Oct. 16, 2008 PTO Office Action.
U.S. Appl. No. 11/400,280—Oct. 24, 2008 Response to PTO Office Action of Oct. 16, 2008.
U.S. Appl. No. 11/410,905—Sep. 26, 2008 PTO Office Action.
U.S. Appl. No. 11/410,905—Mar. 26, 2008 Response to PTO Office Action of Sep. 26, 2008.
U.S. Appl. No. 11/410,924—Mar. 6, 2009 PTO Office Action.
U.S. Appl. No. 11/411,120—Mar. 19, 2009 PTO Office Action.
U.S. Appl. No. 11/411,129—Jan. 16, 2009 Office Action.
U.S. Appl. No. 11/411,130—May 1, 2008 PTO Office Action.
U.S. Appl. No. 11/411,130—Oct. 29, 2008 Response to PTO Office Action of May 1, 2008.
U.S. Appl. No. 11/417,129—Jul. 11, 2007 PTO Office Action.
U.S. Appl. No. 11/417,129—Dec. 17, 2007 Response to PTO Office Action of Jul. 11, 2007.
U.S. Appl. No. 11/417,129—Dec. 20, 2007 Response to PTO Office Action of Jul. 11, 2007.
U.S. Appl. No. 11/417,129—Apr. 17, 2008 PTO Office Action.
U.S. Appl. No. 11/417,129—Jun. 19, 2008 Response to PTO Office Action of Apr. 17, 2008.
U.S. Appl. No. 11/418,079—Apr. 11, 2008 PTO Office Action.
U.S. Appl. No. 11/418,079—Oct. 7, 2008 Response to PTO Office Action of Apr. 11, 2008.
U.S. Appl. No. 11/418,079—Feb. 12, 2009 PTO Office Action.
U.S. Appl. No. 11/418,080—Mar. 18, 2009 PTO Office Action.
U.S. Appl. No. 11/418,082—Jan. 17, 2007 PTO Office Action.
U.S. Appl. No. 11/418,083—Jun. 20, 2008 PTO Office Action.
U.S. Appl. No. 11/418,083—Dec. 18, 2008 Response to PTO Office Action of Jun. 20, 2008.
U.S. Appl. No. 11/418,084—Nov. 5, 2007 PTO Office Action.
U.S. Appl. No. 11/418,084—May 5, 2008 Response to PTO Office Action of Nov. 5, 2007.
U.S. Appl. No. 11/418,084—Aug. 19, 2008 PTO Office Action.
U.S. Appl. No. 11/418,084—Feb. 19, 2009 Response to PTO Office Action of Aug. 19, 2008.
U.S. Appl. No. 11/418,085—Aug. 10, 2007 PTO Office Action.
U.S. Appl. No. 11/418,085—Nov. 13, 2007 Response to PTO Office Action of Aug. 10, 2007.
U.S. Appl. No. 11/418,085—Feb. 12, 2008 PTO Office Action.
U.S. Appl. No. 11/418,085—Aug. 12, 2008 Response to PTO Office Action of Feb. 12, 2008.
U.S. Appl. No. 11/418,085—Sep. 16, 2008 PTO Office Action.
U.S. Appl. No. 11/418,085—Mar. 6, 2009 Response to PTO Office Action of Sep. 16, 2008.
U.S. Appl. No. 11/418,087—Dec. 29, 2006 Response to PTO Office Action of Dec. 4, 2006.
U.S. Appl. No. 11/418,087—Feb. 15, 2007 PTO Office Action.
U.S. Appl. No. 11/418,087—Mar. 6, 2007 Response to PTO Office Action of Feb. 15, 2007.
U.S. Appl. No. 11/418,088—Jun. 9, 2008 PTO Office Action.
U.S. Appl. No. 11/418,088—Dec. 8, 2008 Response to PTO Office Action of Jun. 9, 2008.
U.S. Appl. No. 11/418,089—Mar. 21, 2008 PTO Office Action.
U.S. Appl. No. 11/418,089—Jun. 23, 2008 Response to PTO Office Action of Mar. 21, 2008.
U.S. Appl. No. 11/418,089—Sep. 30, 2008 PTO Office Action.
U.S. Appl. No. 11/418,089—Mar. 30, 2009 Response to PTO Office Action of Sep. 30, 2008.
U.S. Appl. No. 11/418,091—Jul. 30, 2007 PTO Office Action.
U.S. Appl. No. 11/418,091—Nov. 27, 2007 Response to PTO Office Action of Jul. 30, 2007.
U.S. Appl. No. 11/418,091—Feb. 26, 2008 PTO Office Action.
U.S. Appl. No. 11/418,097—Jun. 2, 2008 PTO Office Action.
U.S. Appl. No. 11/418,097—Dec. 2, 2008 Response to PTO Office Action of Jun. 2, 2008.
U.S. Appl. No. 11/418,097—Feb. 18, 2009 PTO Office Action.
U.S. Appl. No. 11/418,099—Jun. 23, 2008 PTO Office Action.
U.S. Appl. No. 11/418,099—Dec. 23, 2008 Response to PTO Office Action of Jun. 23, 2008.
U.S. Appl. No. 11/418,100—Jan. 12, 2009 PTO Office Action.
U.S. Appl. No. 11/418,123—Apr. 25, 2008 PTO Office Action.
U.S. Appl. No. 11/418,123—Oct. 27, 2008 Response to PTO Office Action of Apr. 25, 2008.
U.S. Appl. No. 11/418,123—Jan. 26, 2009 PTO Office Action.
U.S. Appl. No. 11/418,124—Oct. 1, 2008 PTO Office Action.
U.S. Appl. No. 11/418,124—Feb. 2, 2009 Response to PTO Office Action of Oct. 1, 2008.
U.S. Appl. No. 11/418,124—Mar. 13, 2009 PTO Office Action.
U.S. Appl. No. 11/418,126—Oct. 12, 2006 PTO Office Action.
U.S. Appl. No. 11/418,126—Feb. 12, 2007 Response to PTO Office Action of Oct. 12, 2007 (Redacted).
U.S. Appl. No. 11/418,126—Jun. 6, 2007 PTO Office Action.
U.S. Appl. No. 11/418,126—Aug. 6, 2007 Response to PTO Office Action of Jun. 6, 2007.
U.S. Appl. No. 11/418,126—Nov. 2, 2007 PTO Office Action.
U.S. Appl. No. 11/418,126—Feb. 22, 2008 Response to PTO Office Action of Nov. 2, 2007.
U.S. Appl. No. 11/418,126—Jun. 10, 2008 PTO Office Action.
U.S. Appl. No. 11/418,127—Apr. 2, 2009 Office Action.
U.S. Appl. No. 11/418,128—Dec. 16, 2008 PTO Office Action.
U.S. Appl. No. 11/418,128—Dec. 31, 2008 Response to PTO Office Action of Dec. 16, 2008.
U.S. Appl. No. 11/418,128—Feb. 17, 2009 PTO Office Action.
U.S. Appl. No. 11/418,129—Dec. 16, 2008 Office Action.
U.S. Appl. No. 11/418,129—Dec. 31, 2008 Response to PTO Office Action of Dec. 16, 2008.
U.S. Appl. No. 11/418,244—Jul. 1, 2008 PTO Office Action.
U.S. Appl. No. 11/418,244—Nov. 25, 2008 Response to PTO Office Action of Jul. 1, 2008.
U.S. Appl. No. 11/418,263—Sep. 24, 2008 PTO Office Action.
U.S. Appl. No. 11/418,263—Dec. 24, 2008 Response to PTO Office Action of Sep. 24, 2008.
U.S. Appl. No. 11/418,263—Mar. 9, 2009 PTO Office Action.
U.S. Appl. No. 11/418,315—Mar. 31, 2008 PTO Office Action.
U.S. Appl. No. 11/418,318—Mar. 31, 2009 PTO Office Action.
U.S. Appl. No. 11/441,219—Jan. 7, 2009 PTO Office Action.
U.S. Appl. No. 11/522,929—Oct. 22, 2007 PTO Office Action.
U.S. Appl. No. 11/522,929—Feb. 21, 2008 Response to PTO Office Action of Oct. 22, 2007.
U.S. Appl. No. 11/641,678—Jul. 22, 2008 PTO Office Action.
U.S. Appl. No. 11/641,678—Jan. 22, 2009 Response to Office Action of Jul. 22, 2008.
U.S. Appl. No. 11/711,000—Mar. 6, 2009 PTO Office Action.
U.S. Appl. No. 11/716,552—Feb. 12, 2009 Response to PTO Office Action of Feb. 9, 2009.
U.S. Appl. No. 11/716,552—Jul. 3, 2008 PTO Office Action.
"Notice of Allowability" mailed on Jul. 2, 2009 in U.S. Appl. No. 11/410,905, filed Apr. 26, 2006.
"Notice of Allowability" mailed on Jun. 30, 2009 in U.S. Appl. No. 11/418,084, filed May 5, 2006.
B. B Loechel et al., "Fabrication of Magnetic Microstructures by Using Thick Layer Resists", Microelectronics Eng., vol. 21, pp. 463-466 (1993).
Magellan 8500 Scanner Product Reference Guide, PSC Inc., 2004, pp. 6-27-F18.
Magellan 9500 with SmartSentry Quick Reference Guide, PSC Inc., 2004.
Response to Non-Final Office Action submitted May 13, 2009 in U.S. Appl. No. 11/203,407.
U.S. Appl. No. 11/238,991—May 11, 2009 PTO Office Action.
U.S. Appl. No. 11/350,812—Apr. 17, 2009 Office Action.
U.S. Appl. No. 11/411,130—Jun. 23, 2009 PTO Office Action.
U.S. Appl. No. 11/418,089—Jul. 15, 2009 PTO Office Action.
U.S. Appl. No. 11/418,096—Jun. 23, 2009 PTO Office Action.

U.S. Appl. No. 11/433,486—Jun. 19, 2009 PTO Office Action.
Brau et al., "Tribute to John E Walsh", Nuclear Instruments and Methods in Physics Research Section A. Accelerators, Spectrometers, Detectors and Associated Equipment, vol. 475, Issues 1-3, Dec. 21, 2001, pp. xiii-xiv.
Kapp, et al., "Modification of a scanning electron microscope to produce Smith-Purcell radiation", Rev. Sci. Instrum. 75, 4732 (2004).
Scherer et al. "Photonic Crystals for Confining, Guiding, and Emitting Light", IEEE Transactions on Nanotechnology, vol. 1, No. 1, Mar. 2002, pp. 4-11.
U.S. Appl. No. 11/203,407—Jul. 17, 2009 PTO Office Action.
U.S. Appl. No. 11/418,097—Sep. 16, 2009 PTO Office Action.
U.S. Appl. No. 11/418,123—Aug. 11, 2009 PTO Office Action.
U.S. Appl. No. 11/418,365—Jul. 23, 2009 PTO Office Action.
U.S. Appl. No. 11/441,240—Aug. 31, 2009 PTO Office Action.
Urata et al., "Superradiant Smith-Purcell Emission", Phys. Rev. Lett. 80, 516-519 (1998).

* cited by examiner

INTEGRATED FILTER IN ANTENNA-BASED DETECTOR

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

CROSS-REFERENCE TO RELATED APPLICATIONS

This application is related to and claims priority from the following U.S. patent applications, the entire contents of each of which are incorporated herein by reference:

(1) U.S. Provisional Patent Application No. 60/777,120, titled "Systems and Methods of Utilizing Resonant Structures," filed Feb. 28, 2006; and (2) U.S. patent application Ser. No. 11/417,129, titled "Integrated Filter in Antenna-Based Detector," filed May 4, 2006.

The present invention is related to the following co-pending U.S. patent applications which are all commonly owned with the present application, the entire contents of each of which are incorporated herein by reference:

(1) U.S. patent application Ser. No. 11/238,991, entitled "Ultra-Small Resonating Charged Particle Beam Modulator," and filed Sep. 30, 2005;

(2) U.S. patent application Ser. No. 10/917,511, entitled "Patterning Thin Metal Film by Dry Reactive Ion Etching," filed on Aug. 13, 2004;

(3) U.S. application Ser. No. 11/203,407, entitled "Method Of Patterning Ultra-Small Structures," filed on Aug. 15, 2005;

(4) U.S. application Ser. No. 11/243,476, entitled "Structures And Methods For Coupling Energy From An Electromagnetic Wave," filed on Oct. 5, 2005;

(5) U.S. application Ser. No. 11/243,477, entitled "Electron beam induced resonance," filed on Oct. 5, 2005;

(6) U.S. application Ser. No. 11/325,432, entitled "Resonant Structure-Based Display," filed on Jan. 5, 2006;

(7) U.S. application Ser. No. 11/410,924, entitled "Selectable Frequency EMR Emitter," filed on Apr. 26, 2006; and (8) U.S. application Ser. No. 11/400,280, entitled "Resonant Detector For Optical Signals," filed on Apr. 10, 2006.

FIELD OF THE DISCLOSURE

This relates to ultra-small devices, and, more particularly, to ultra-small antennas.

INTRODUCTION & BACKGROUND

Antennas are used for detecting electromagnetic radiation (EMR) of a particular frequency.

As is well known, frequency (f) of a wave has an inverse relationship to wavelength (generally denoted $\lambda$). The wavelength is equal to the speed of the wave type divided by the frequency of the wave. When dealing with electromagnetic radiation (EMR) in a vacuum, this speed is the speed of light c in a vacuum. The relationship between the wavelength $\lambda$ of an electromagnetic wave its frequency f is given by the equation:

$$f = \frac{c}{\lambda}$$

As shown in FIG. 1, a typical antenna 10 is formed to detect electromagnetic waves having a certain frequency f, with a corresponding wavelength ($\lambda_m$). This desired frequency may be referred to herein as the desired detection frequency. The antenna 10 is a so-called quarter wavelength antenna, and its length is a multiple (preferably an odd multiple) of a quarter of the desired detection wavelength, i.e., an odd multiple of ¼ $\lambda_m$.

Note that when a electromagnetic wave (W) with wavelength $\lambda_m$ is incident on the antenna 10, this causes a standing wave (denoted by the dashed line in the drawing) to be formed in the antenna. The standing wave is reflected of the end of the antenna, to form a second standing wave (denoted by the dotted line in the drawing). The wavelength of the standing wave is ½ $\lambda_m$.

When an electromagnetic wave travels through a dielectric, the velocity of the wave will be reduced and it will effectively behave as if it had a shorter wavelength. Generally, when an electromagnetic wave enters a medium, its wavelength is reduced (by a factor equal to the refractive index n of the medium) but the frequency of the wave is unchanged. The wavelength of the wave in the medium, $\lambda'$ is given by:

$$\lambda' = \frac{\lambda_0}{n}$$

where $\lambda_0$ is the vacuum wavelength of the wave. Note that the antenna 10 shown in FIG. 1 is formed of a homogenous material, typically a metal.

It is desirable to have more selectivity/sensitivity to specific frequencies in antenna detectors.

BRIEF DESCRIPTION OF THE DRAWINGS

The following description, given with respect to the attached drawings, may be better understood with reference to the non-limiting examples of the drawings, wherein.

THE PRESENTLY PREFERRED EXEMPLARY EMBODIMENTS

Figure 1:
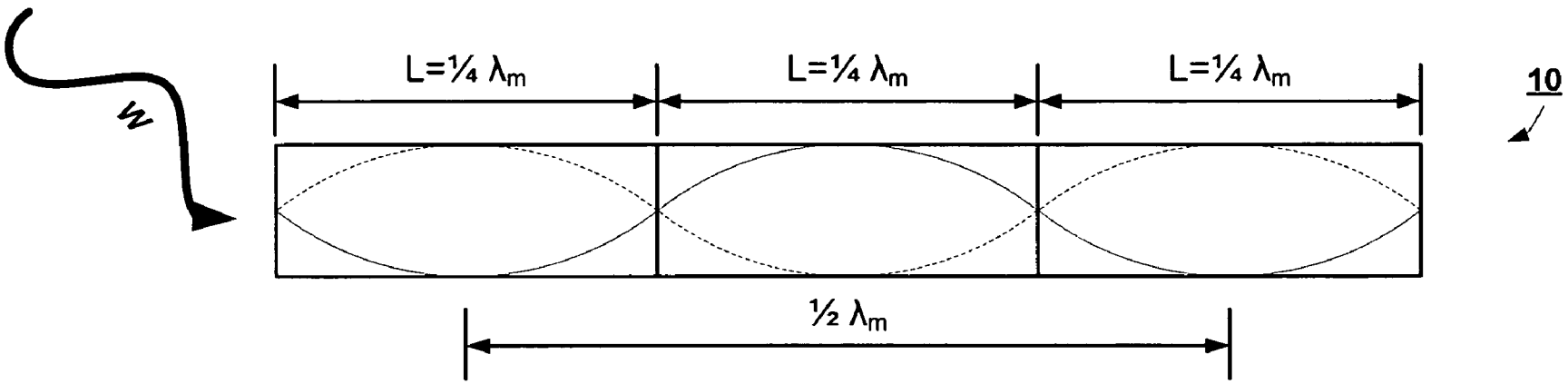
FIG. 1 shows various aspects of operation of an antenna.
Figure 2A:
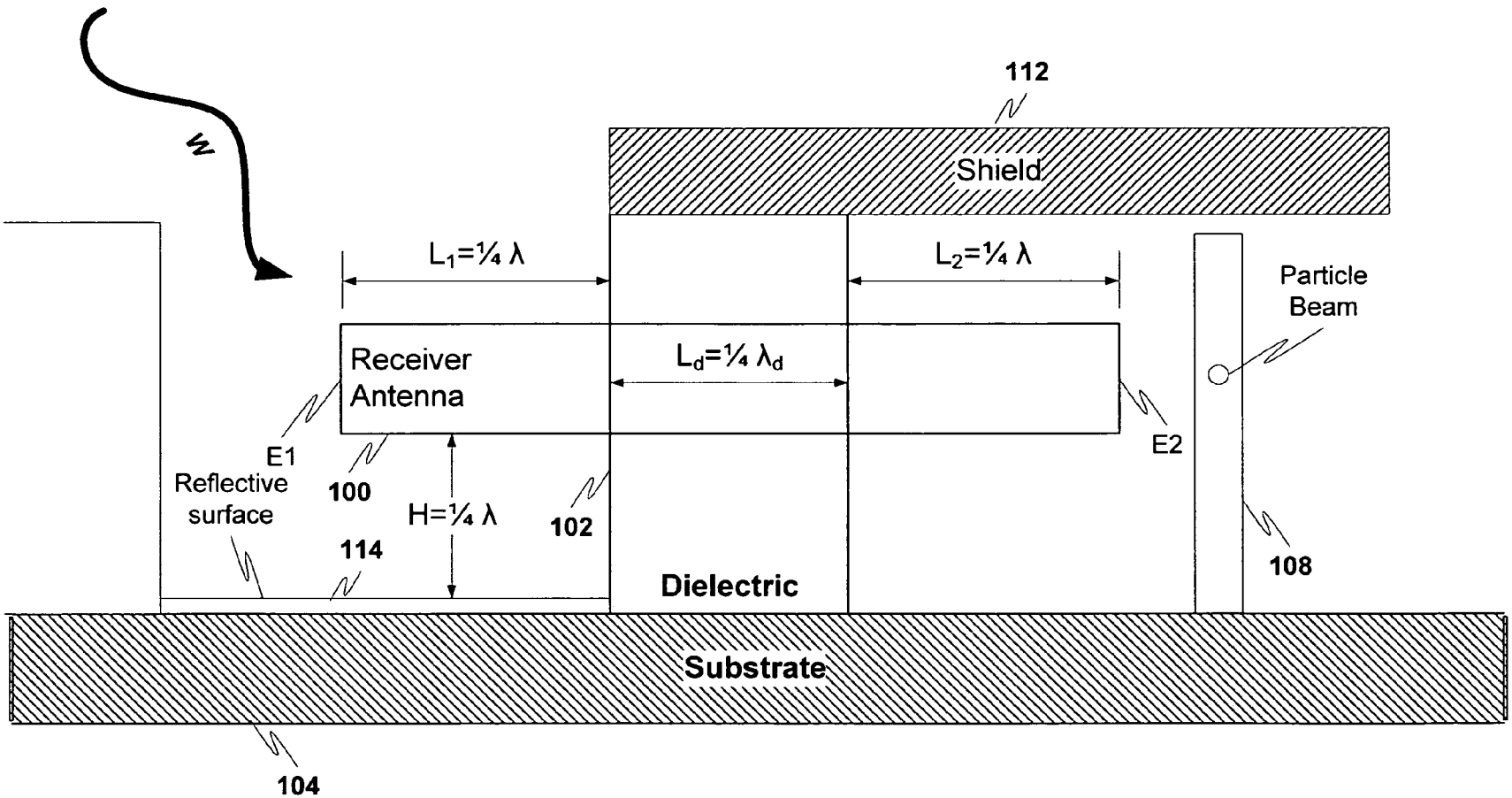
FIGS. 2(*a*)-2(*b*) are side views of an antenna with an integrated filter.
Figure 2B:
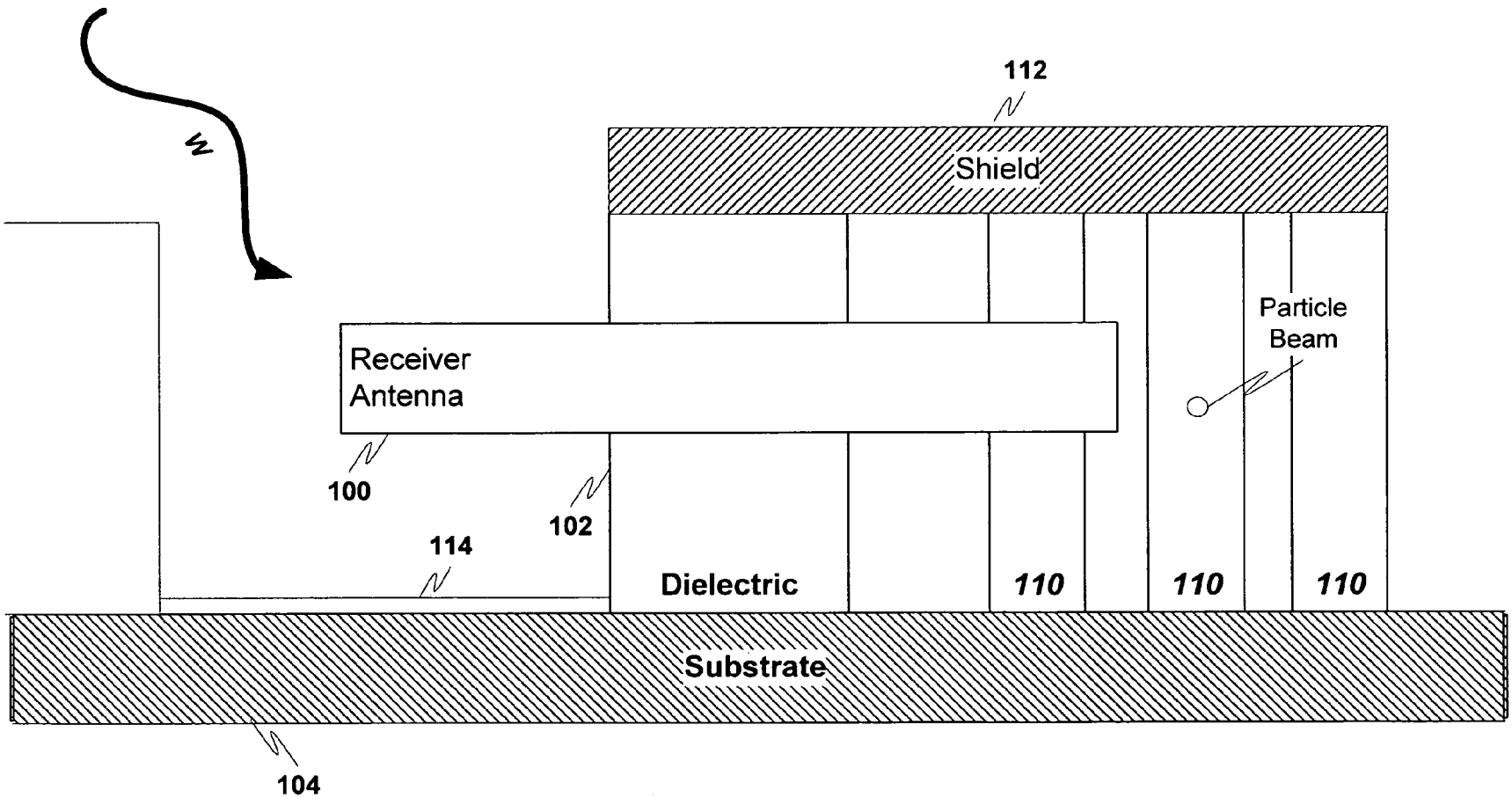

FIGS. 2(*a*), 2(*b*) and 3 show two side views and a top view, respectively, of an antenna 100 formed within a dielectric structure 102. The dielectric 102 may be formed on a substrate 104. A detector system 106 is coupled with the antenna. The detector system may comprise an emitter 108 (a source of charged particles) and a detector 110 (not shown in FIG. 1) Various structures for the emitter/detector are disclosed in co-pending U.S. patent application Ser. No. 11/400,280, entitled "Resonant Detector For Optical Signals," and filed on Apr. 10, 2006, the entire contents of which have been incorporated herein by reference. The detector system may be formed on substrate 104 or elsewhere.

Preferably the detector system 106 is disposed at end E2 of the antenna system.

Although shown as rectangular, the end E2 of the antenna may be pointed to intensify the field.

Figure 3:
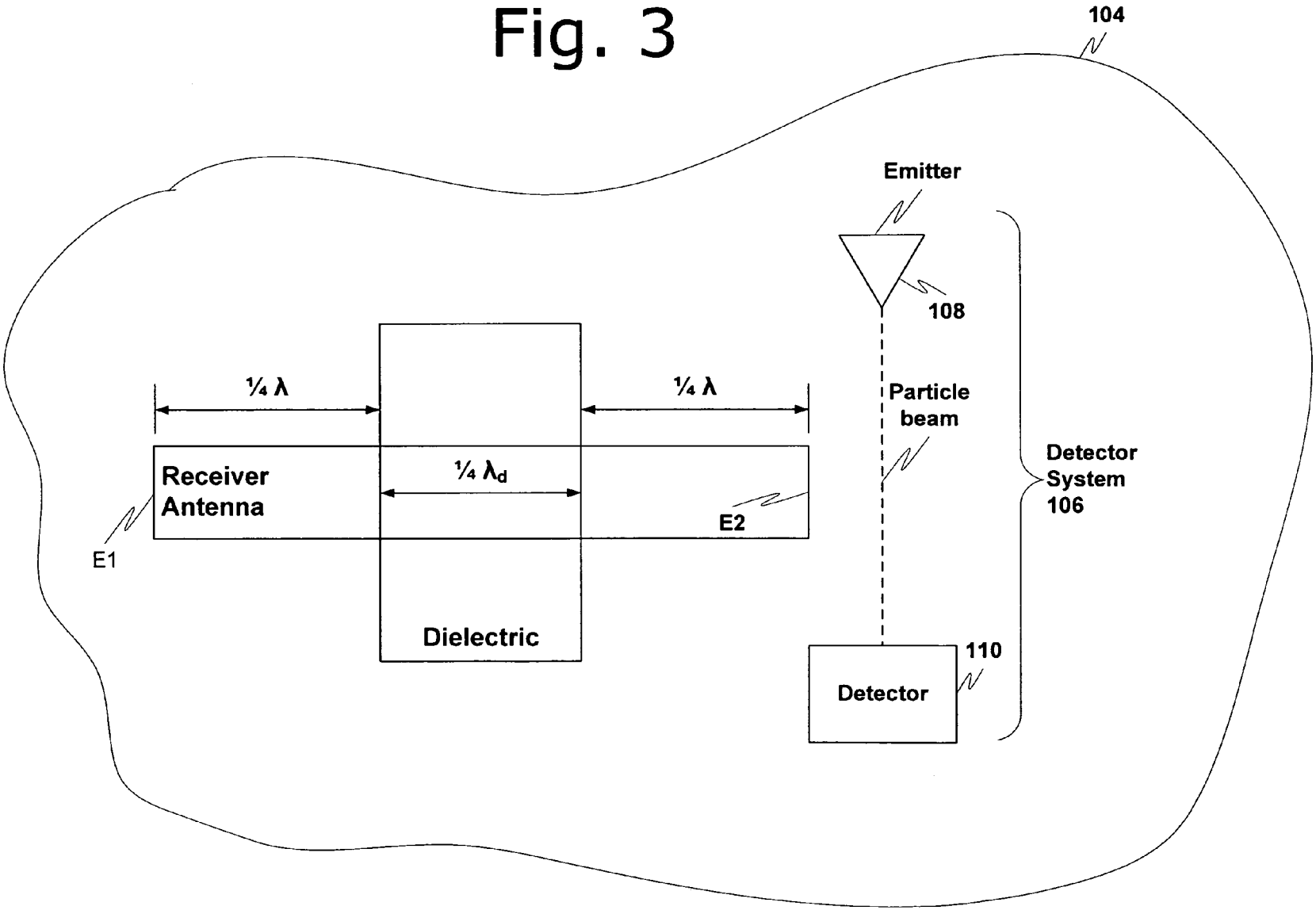
FIG. 3 is a top view of an antenna with an integrated filter.

A shield structure 112 (not shown in FIG. 3) is formed to block EMR from interacting with the detector system 106, in particular, with the particle beam emitted by the emitter 108. The shield 112 may be formed on a top surface of the dielectric structure.

An optional reflective surface 114 may be formed on the substrate 104 to reflect EMR to a receiving end E1 of the antenna 100.

The entire antenna structure, including the detection system, should preferably be provided within a vacuum.

For the purposes of this description, the antenna has three logical portions, namely a first antenna portion (shown in the drawing to the left of the dielectric structure 102), a second antenna portion within the dielectric structure, and a third antenna portion (shown in the drawing to the right of the dielectric structure).

The antenna 100 is formed to detect electromagnetic waves having a certain frequency f, with corresponding wavelength ($\lambda$). Accordingly, the length of the first antenna portion, $L_1$ and that of the third antenna portion $L_2$ are both ¼ $\lambda$. The length $L_d$ of the second antenna portion, the portion within the dielectric, is ¼ $\lambda_d$, where $\lambda_d$ is the wavelength of the signal within the dielectric 102. The antenna 100 is formed at a height H of ¼ $\lambda$ above the substrate 104.

Figure 4:
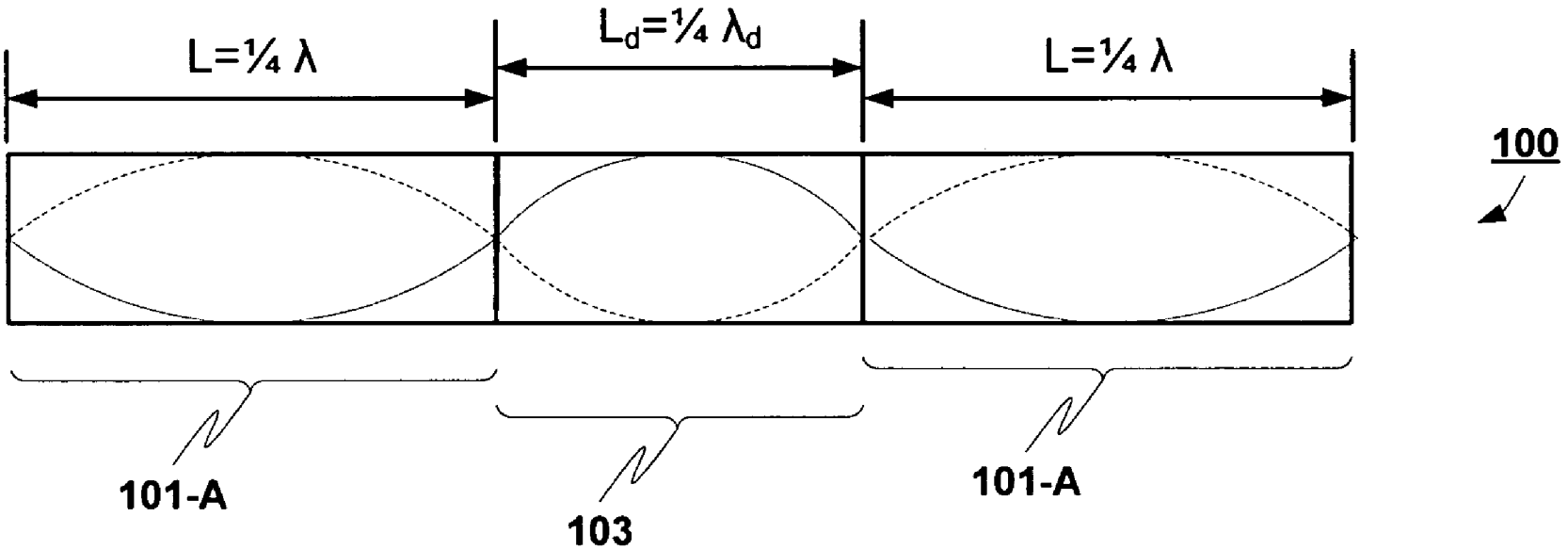
FIG. 4 shows various aspects of operation of an antenna.
Figure 5A:
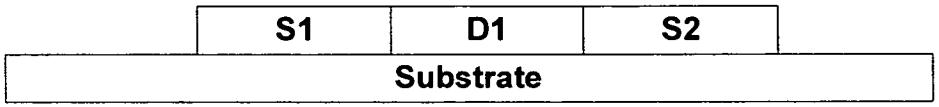
FIGS. 5(*a*)-5(*d*) show an exemplary process for making an antenna structure.
Figure 5B:
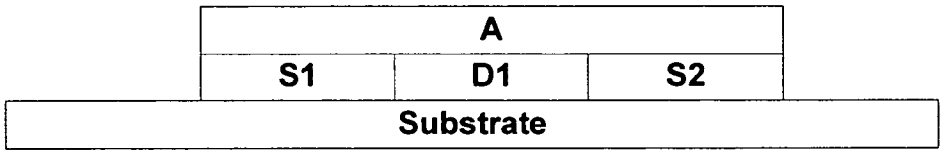
Figure 5C:
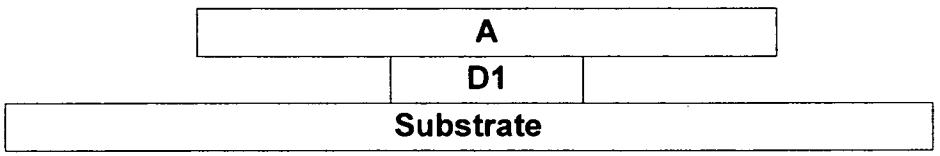
Figure 5D:
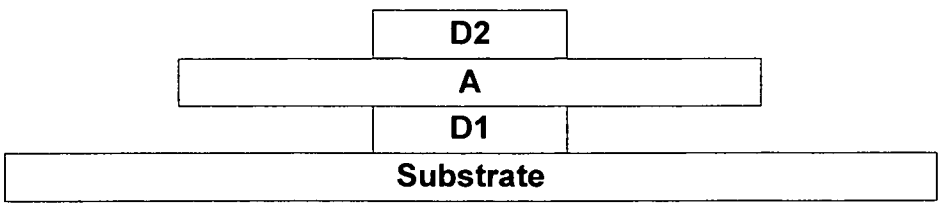

Recall that when an electromagnetic wave travels through a dielectric, its wavelength is reduced but the frequency of the wave is unchanged. The dielectric structure thus acts as a filter for a received signal, allowing EMR of the appropriate wavelength to pass therethrough. FIG. 4 shows the standing wave (s) formed in the antenna 100. As can be seen from the drawing, in the two metal segments 101-A, and 101-B, the wavelength of the standing wave is ¼ $\lambda$, whereas in the dielectric segment 103, the wavelength of the standing wave is ¼ $\lambda_d$—i.e., the wavelength corresponding to dielectric. The dimensions of the dielectric element can be determined, e.g., based on the relationship between the dielectric constants of the antenna material and the dielectric, e.g., using the following equation:

$$\frac{l_v}{l_d} = \sqrt{\frac{e_d(e_m + 1)}{e_m + e_d}}$$

where $l_v$ is the length of the metal portion (corresponding to $\lambda_v$, the wavelength of the wave in a vacuum), and $l_d$ is the length of the dielectric portion (corresponding to $\lambda_d$ is the wavelength of the wave in the dielectric material); $e_d$ is the dielectric constant of the dielectric material and $e_m$ is the dielectric constant of the metal. Those skilled in the art will understand that $l_v/l_d = \lambda_v/\lambda_d$).

From this equation, the value of $l_d$ can be determined as:

$$l_d = \frac{l_v\sqrt{e_d + e_m}}{\sqrt{e_d(e_m + 1)}}$$

The dielectric layer acts as a support for the antenna, and a filter.

The antenna structures may be formed of a metal such as silver (Ag).

With reference to FIGS. 5(*a*)-5(*d*), the antenna structures may be formed as follows (although other methods may be used):

First, the dielectric (D1) is formed on the substrate, along with two sacrificial portions (S1, S2) (FIG. 5(*a*)). The antenna (A) is then formed on the dielectric (D1) and the two sacrificial portions (S1, S2) (FIG. 5(*b*)). The sacrificial portions can then be removed (FIG. 5(*c*)), and then remainder of the dielectric (D2) can be formed on the antenna.

As shown in the drawings, the antenna comprises three portions, namely metal, dielectric, metal. Those skilled in the art will realize, upon reading this description, that the antenna may comprise three metal portions (e.g., in the order $metal_A$, $metal_B$, $metal_A$, where $metal_A$ and $metal_B$ different metals, e.g., silver and gold). Those skilled in the art will realize, upon reading this description, that the antenna may comprise three dielectric portions (e.g., in the order $D_a$, $D_b$, $D_a$, where $D_a$ and $D_b$ are different dielectric materials).

While certain configurations of structures have been illustrated for the purposes of presenting the basic structures of the present invention, one of ordinary skill in the art will appreciate that other variations are possible which would still fall within the scope of the appended claims. While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. An antenna system comprising:

a dielectric structure;

an antenna, partially within the dielectric structure, and supported by the dielectric structure; and a detection system disposed to detect electrical field changes in the antenna, wherein:

the antenna comprises:

a first metal portion on one side of the dielectric structure;

a middle portion comprising a portion of the dielectric structure; and a second metal portion on another side of the dielectric structure, and the first metal portion and the second metal portions are comprised of different metals.

2. A system as in claim 1 wherein the dielectric structure is formed on a substrate, the system further comprising:

a reflective surface formed on the substrate.

3. A system as in claim 1 further comprising:

a shield blocking radiation from a portion of the antenna.

4. A system as in claim 3 wherein the shield also blocks radiation from the dielectric structure.

5. A system as in claim 3 wherein the shield is supported by the dielectric structure.

6. A system as in claim 1 wherein the length of the first metal portion is substantially equal to the length of the second metal portion.

7. A system as in claim 6 wherein the length of the dielectric portion of the antenna is based, at least in part, as a function of the dielectric constant of the dielectric material.

8. A system as in claim 1 wherein the detection system includes a source of charged particles.

9. A system as in claim 1 wherein the first metal portion and the second metal portions are comprised of the same metal.

10. An antenna comprising:

a dielectric portion having a first length;

a first metal portion having a second on a first side of the dielectric portion; and a second metal portion, different from the first metal portion, having a third length on a second side of the dielectric portion;

wherein the antenna is constructed and adapted to detect electromagnetic waves having a particular frequency, and wherein the first length, second length, and third length are each based, at least in part, on a function of the particular frequency.

11. An antenna system comprising:

a first antenna portion;

a second antenna portion on a first side of the first antenna portion; and a third antenna portion on a second side of the first antenna portion, a shield blocking radiation from at least a part of the antenna; and a detection system disposed to detect electrical field changes in the antenna, wherein the detection system includes a source of charged particles, wherein:

the first antenna portion and the third antenna portion comprise a first metal the second antenna portion comprises a second metal, the first antenna portion and the third antenna portion comprise a first dielectric material; and the second antenna portion comprises a second dielectric material.

12. An antenna system as in claim 11 wherein:

the first antenna portion and the third antenna portion comprise a metal; and the second antenna portion comprises a dielectric material.

* * * * *